United States Patent [19]

Troncoso et al.

[11] Patent Number: 4,953,521

[45] Date of Patent: Sep. 4, 1990

[54] ARCHERY BOW ASSEMBLY

[75] Inventors: Vincent F. Troncoso, Montrose, Colo.; Richard Gangloff, Caliente, Calif.

[73] Assignee: Golden Key-Futura, Inc., Montrose, Colo.

[21] Appl. No.: 452,346

[22] Filed: Dec. 18, 1989

[51] Int. Cl.[5] ..... F41B 5/00

[52] U.S. Cl. ..... 124/24.1; 124/44.5

[58] Field of Search ..... 124/24 R, 41 A, 88, 124/DIG. 1, 24 A

[56] References Cited

U.S. PATENT DOCUMENTS

| | | | |
|---|---|---|---|
| 2,975,780 | 3/1961 | Fisher | 124/24 R |
| 3,504,659 | 4/1970 | Babington | 124/24 R |
| 3,918,428 | 11/1975 | Wilson | 124/41 A |
| 4,119,078 | 10/1978 | Wilson | 124/41 A |
| 4,287,868 | 9/1981 | Schiff | 124/24 R X |
| 4,344,409 | 8/1982 | Barner | 124/24 R |
| 4,579,101 | 4/1986 | Bateman, III | 124/24 R X |
| 4,865,007 | 9/1989 | Saunders | 124/24 R X |

*Primary Examiner*—Randolph A. Reese
*Assistant Examiner*—Jeffrey L. Thompson
*Attorney, Agent, or Firm*—Donald E. Nist

[57] ABSTRACT

The archery bow assembly includes an archery bow having a pair of limbs connected to a central riser handle defining an arrow window and interconnected by a bowstring. It also includes a pendulum-type disappearing arrow rest with a side pressure point. The rest includes a pair of generally flat, forwardly extending, flexible, resilient inner and outer blades. The inner blade lies next to the sidewall of the arrow window and includes a front support adapted to project through a notch in the outer blade to support an arrow when the inner blade is biased outwardly. The outer blade serves as a side pressure plate and may have a single pressure point. The rear ends of the blades are connected to a transverse bar slideably or threadably received in the rear end of a mounting block connected to the sidewall of the riser opposite the window and extending rearwardly thereof. A pin is slideably disposed in a hollow tube passing transversely through the riser into communication with the window. The pin has one end bearing against the inner blade and the opposite end projecting out the tube and an opening in a flat pendulum plate pivotably connected to the tube for swinging movement forwardly and rearwardly. The pin can be biased against the inner blade so that a notch in the pin engages the plate, forcing the arrow support portion of the blade to an operative position. When an arrow is fired from the bow the vibration caused thereby automatically disengages the plate from the notch and allows the arrow support portion to spring back to a retracted arrow-clearing position.

6 Claims, 2 Drawing Sheets

ARCHERY BOW ASSEMBLY

BACKGROUND OF THE INVENTION

1. FIELD OF THE INVENTION

The present invention generally relates to sports equipment and more particularly to an improved archery bow assembly utilizing a pendulum-type disappearing arrow rest.

2. PRIOR ART

Many attempts have been made in the past to provide a successful disappearing arrow rest which will not interfere with the flight of the arrow through the bow. In most instances, not only has the rest not completely disappeared, but is relatively expensive to make, is subject to breakage and still interferes with arrow flight, the arrow vanes typically striking the rest and causing vane damage, arrow wobble and poor arrow flight and shooting accuracy. Those magnetic rests which provide a horizontal swinging wire support do not yield vertically and must be struck by the vanes before swinging horizontally out of the way. The wire rest still slices the vanes and deflects the arrow.

There remains a need for an inexpensive, durable arrow rest which completely clears out of the path of the arrow through the bow when the bow is shot and before the arrow vanes can reach the rest. Such rest should be simple to construct, operate and adjust, provide a resilient vertical cushioning support for proper arrow flight and be fabricated from easily available materials. Preferably, the rest should incorporate an integral yielding side pressure plate or point so that a cushion type so-called Burger button or plunger is not needed for the bow.

SUMMARY OF THE INVENTION

The improved archery bow assembly of the present invention satisfies all the foregoing needs. The assembly is substantially as set forth in the Abstract of the Disclosure.

Thus, the assembly comprises an archery bow having a pair of limbs connected to a central riser handle defining an arrow window above an arrow shelf and interconnected by a bowstring. The assembly also includes a pendulum-type disappearing arrow rest with a side pressure point. The rest has a pair of generally flat, forwardly extending, flexible, resilient inner and outer blades disposed in side by side relation with the flat sides thereof generally parallel with the sidewall of the riser defining the arrow window.

The inner blade lies next to the sidewall in the arrow window and includes a front support which is bent at a slight angle away from the sidewall and is relatively low in profile. It is adapted to project outwardly away from the sidewall into the window when biased by a pin as hereinafter described. When so biased it projects through an opening in the outer blade and in that position supports an arrow in the window outwardly or laterally of the outer blade.

The outer blade projects forwardly away from the window sidewall at a slight angle but preferably is bent at a single point near the front end thereof toward the sidewall to form a single side pressure point for use in place of a plunger. When the front support of the inner blade is not biased outwardly, the inner blade lies entirely behind the outer blade and next to the sidewall for complete arrow clearance.

The rear ends of the two blades are connected to a transverse bar behind the window, which bar is slideably or threadably adjustably received in the rear end of a mounting block connected to the sidewall on the side opposite that of the window. A pin is slideably disposed in a hollow tube passing transversely through the riser from the side opposite the window and into communication with the window. The pin has one end bearing against the inner blade front support or another adjacent part of the same blade and the opposite end of the pin projects out of the tube and through an opening in a flat pendulum plate pivotably connected to that end of the tube for swinging movement forwardly and rearwardly.

The pin can be biased against the front support of the inner blade to force it laterally outwardly into the window into an arrow supporting position and can be held in that position by engaging an edge of the pendulum plate in a notch in the pin. When the arrow is fired from the bow, the vibration caused by the firing passes through the bow ahead of the arrow and automatically disengages the plate from the pin, allowing the spring action of the front support of the inner blade to instantly move that front support to the concealed non-supporting position behind the outer blade, thus providing a completely unobstructed arrow pathway through the bow window for perfect arrow flight. No damage whatsoever occurs to the arrow shaft or vanes since they are not touched by the front support at all.

Deflected arrow flight and vane damage normally occur with conventional rests, particularly when the arrow is shot from a compound bow with a mechanical release aid because the arrow in that instance flies forwardly through the bow very close to the sidewall, rather than following an S-curve path, such as is seen when the fingers are used for the release from a non-compound bow. However, a compound bow is able to be shot with a mechanical release and utilizing the present improved rest with perfect results, that is, no striking of the arrow and rest and no wear on the arrow. Arrow flight is greatly improved.

Various other features of the improved archery bow assembly of the present invention are set forth in the following detailed description and accompanying drawings.

DRAWINGS

DETAILED DESCRIPTION

Figure 1:
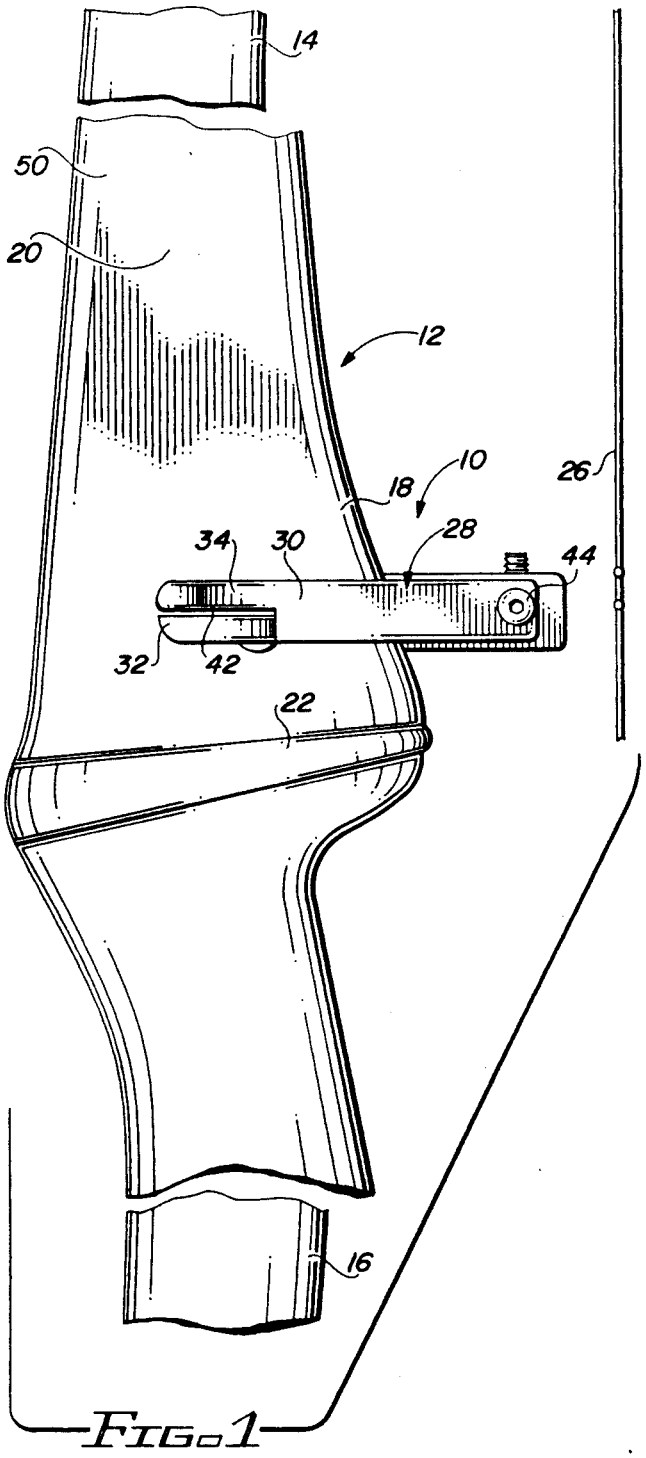
FIG. 1 is a schematic, fragmentary side elevation of a preferred embodiment of the improved archery bow assembly of the present invention, showing the bow arrow window and improved arrow rest with integral side pressure plate.

FIGS. 1-8.

Now referring more particularly to FIGS. 1-8 of the drawings, a preferred embodiment of the improved archery bow assembly of the present invention is schematically depicted therein. Thus, assembly 10 is shown which comprises an archery bow 12 which may be a compound bow or a conventional recurve bow or the like having a pair of spaced limbs 14 and 16 (FIG. 1) connected to a central handle riser 18 comprising a vertical sidewall 20 and a horizontal shelf 22 defining an arrow window 24. The tips of the limbs 14 and 16 are interconnected by a vertical bowstring 26.

Assembly 10 also includes a novel arrow rest 28 with integral side pressure plate 30. Rest 28 includes a generally parallel spaced pair of flat, resilient flexible blades 32 and 34 of metal, plastic or the like disposed in side by side relation in window 24 and extending rearwardly thereof. Blades 32 and 34 are generally parallel to sidewall 20 above shelf 22. Blade 32 is the inner of the two blades and lies closer to sidewall 20. It includes a front arrow support 36 which extends at a slight angle outwardly from sidewall 20 into window 24, but in the unbiased position is completely concealed by outer blade 34 (FIG. 7).

Figure 6:
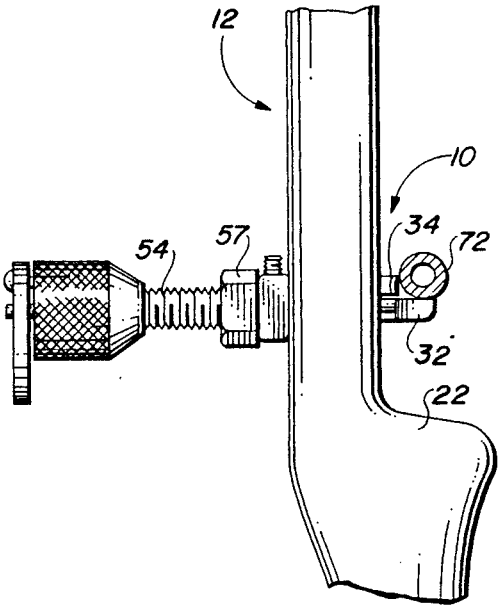
FIG. 6 is a schematic fragmentary front elevation showing the rest of FIG. 1 in the arrow-supporting position of FIG. 4.
Figure 7:
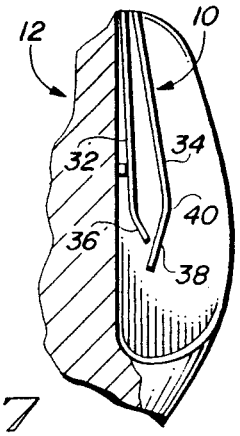
FIG. 7 is a schematic fragmentary top plan view of the assembly of FIG. 1 showing the blades of the rest in the arrow non-supporting position of FIG. 5.
Figure 8:
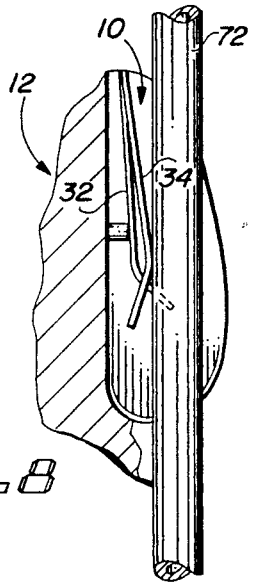
FIG. 8 is a schematic fragmentary top plan view of the assembly of FIG. 1 showing the blades of the rest in the arrow-supporting position of FIG. 6; and, FIG. 9 is a schematic fragmentary rear elevation of the assembly of the present invention showing an alternate embodiment for the transverse bar and mounting block of the assembly.

Outer blade 34 extends forwardly outwardly into window 24 at a slightly larger angle than blade 32 and includes a front portion 38 bent at an angle toward sidewall 20 to form a single arrow side pressure point 40 (FIGS. 7 and 8). Portion 38 nevertheless conceals front support 36 when the latter is unbiased outwardly. Front portion 38 includes a lower opening 42 and front support 36 has a low profile so that it can easily pass laterally outwardly through opening 42 when biased thereto as hereinafter described and as shown in FIGS. 6 and 8.

Figure 2:
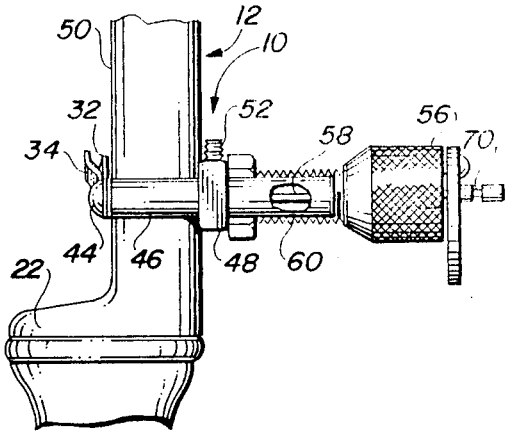
FIG. 2 is a schematic fragmentary rear elevation of the riser portion of the bow of FIG. 1 and the improved arrow rest of FIG. 1.

As shown in FIG. 2 particularly, the rear ends of blades 32 and 34 are connected, as by a button 44 to one end of a bar 46 extending transversely behind window 24. Bar 46 passes transversely through the rear end of a mounting block, the front end of which is fixedly secured to sidewall 20 on the side 50 thereof which is opposite window 24. Bar 46 is releasably pinned in position in block by a set screw 52 or the like, so that the relative lateral position of blades 32 and 34 in window 24 can be controlled by bar 46.

Rest 28 also includes means for biasing front arrow support 36 into and out of supporting position. Such means includes a hollow tube 54 threaded transversely through block 48 and into sidewall 20 from side 50 and extending into communication with window 24. The outer end 56 of tube 54 is expanded into a knurled knob. Tube 54 bears a threaded lock nut 57 which holds block 48 tightly against sidewall 20. Tube 54 has a longitudinal passageway 58 extending all the way therethrough and into communication with window 24.

A pin 60 of metal of the like is slidingly disposed in passageway 58 with one end thereof abutting the inner side of arrow front support 36 or a portion of blade 32 just rearward thereof, while the opposite end of pin 60 projects outwardly of end 56 through an opening 62 in a flat generally triangular pendulum plate 64 the apex 66 of which is hinged by a pin 68 to the outer face of end 56 so that plate 64 is vertical and swings forwardly and rearwardly.

Pin 60 includes a front notch (FIGS. 2 and 5) so that pin 60 can be pushed toward window 24 and a portion of plate 64 defining a forward portion of opening 62 is engaged therein, holding arrow front support 36 in the arrow-supporting position. Thus, support 36 extends laterally outwardly into window 24 through opening 42 in blade 34 (FIG. 8) to hold an arrow 72 from below, with the side thereof abutting side pressure point 40.

Figure 3:
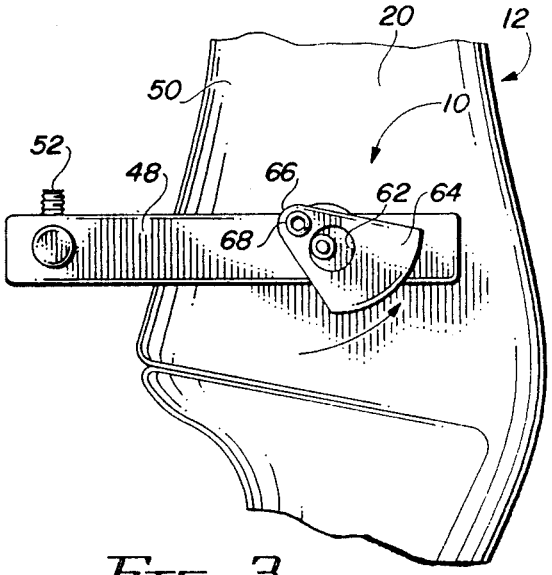
FIG. 3 is a schematic fragmentary side elevation of the assembly of FIG. 1 shown from the side thereof opposite the window, and with the pendulum thereof swing forward into the front support-releasing position for arrow clearance.
Figure 4:
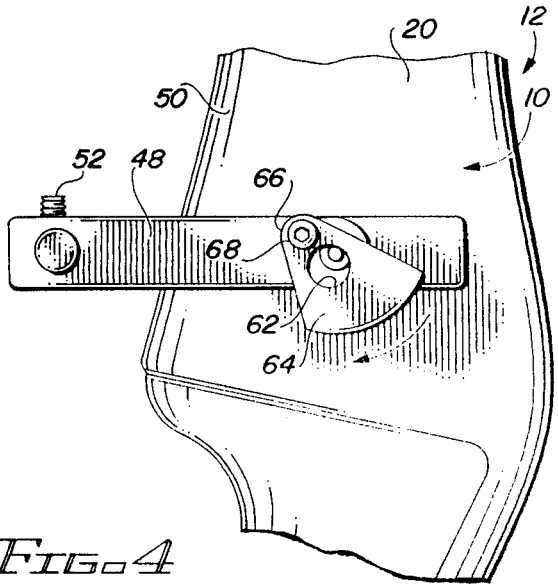
FIG. 4 is a schematic fragmentary side elevation of the assembly of FIG. 1 shown from the side thereof opposite the window, and with the pendulum thereof in the rear cocked position holding the front support of the inner blade of the rest in the arrow-supporting position.
Figure 5:
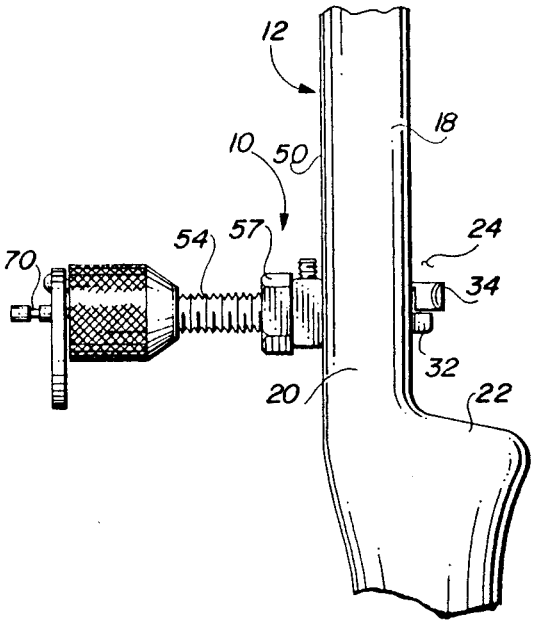
FIG. 5 is a schematic fragmentary front elevation showing the rest of FIG. 1 in the arrow non-supporting position of FIG. 3.

With the described arrangement, when bowstring 26 is drawn back with arrow 72 in place on rest 28 and then fired, the vibration set up in bow 12 due to the firing instantly is communicated to pendulum plate 64 through riser 18, causing plate 64 to swing forward, as shown in FIG. 3, and disengage from pin 60. The spring action of blade 32 then instantly causes front support 36 to swing from the position shown in FIG. 7 towards sidewall 20 and to disappear behind blade 34 to the position shown in FIG. 7 so that arrow 72 completely clears rest 28 without striking any part thereof for perfect arrow flight and no wear or damage to arrow 72.

This improved performance is solely due to rest 28, its components and their relative positions and configurations. Bar 46, block 48, tube 54, pin 60 and plate 64 can be made of any suitable material, such as metal, plastic or the like. Rest 28 can be easily and inexpensively fabricated and is suitable in a variety of sizes and shapes.

FIG. 9.

Figure 9:
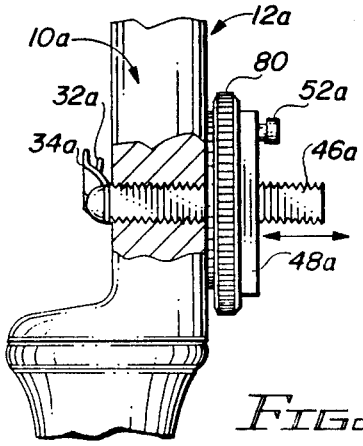

Now referring to FIG. 9 of the drawings, a modified version of the manner in which the bar and block are adjustably connected is illustrated. Thus, assembly **10*a* is shown. Components thereof which are similar to those of assembly 10** bear the same numerals but are succeeded by the letter "a".

Assembly **10*a* differs from assembly 10 only in that bar 46*a* is of square transverse cross-section with threads on the edges thereof and is incrementally fed through openings (not shown) in the forked rear portion of block 48*a* in which an externally knurled forwardly -rearwardly extending wheel 80 is disposed and through a central threaded opening (not shown) of which wheel bar 46*a* transversely passes in engagement therewith. When wheel 80 is turned in one direction, bar 46*a* is incrementally fed in a given direction through wheel 80 so that the lateral position of blades 32*a* and 34*a* can be precisely controlled. A set screw 52*a* passes transversely through block 48*a* and wheel 80 to releasably lock wheel 80 and bar 46*a* in a given position. Assembly 10*a* is otherwise identical to and has the advantages of assembly 10**.

Various other modifications, changes, alterations and additions can be made in the improved archery bow assembly of the present invention and in the improved rest thereof. All such modifications, changes, alterations and additions as are within the scope of the appended claims form part of the present invention.

What is claimed is :

1. An improved archery bow assembly, said assembly comprising, in combination:

(a) an archery bow having a pair of limbs connected to a handle riser defining an arrow window above an arrow shelf, said limbs being interconnected through a bowstring;

(b) a pendulum-type disappearing arrow rest mounted in said handle riser and extending into said arrow window, said rest comprising (i.) a pair of forwardly extending, flexible, resilient inner and outer blades, said inner blade lying next to the sidewall of said riser defining said window and including a front arrow support adapted to project through a notch in said outer blade when said inner blade is biased outwardly, said outer blade serving as a side pressure plate for said arrow;

(i.i.) a transverse bar behind said riser connected to the rear ends of said blades;

(i.i.i.) an elongated mounting block connected to the sidewall of said riser on the side opposite said window, and projecting rearwardly behind said riser and adjustably receiving and securing said bar;

(i.v.) a tube with a central passageway therethrough, passing transversely through and secured to said block and said riser for communication of said passageway with said window;

(v.) a pin slideably disposed in said tube, with one end abutting the inner surface of said inner blade and the opposite end of said pin projecting out of said tube on the side of said riser opposite said window, said pin bearing a notch in said opposite end; and, (v.i.) a flat pendulum plate pivotably mounted on the end of said tube adjacent said pin notch for swinging forwardly and rearwardly, said pin end passing through an opening in said plate, said pin being biasable into said tube against the spring action of said inner blade to releasably engage said p ate in said notch, thereby holding said front support in an arrow-supporting position, but being disengageable therefrom automatically in response to vibration in said bow upon release of said bowstring during shooting, whereby said front support springs back to a retracted non-supporting position for improved arrow and arrow vane clearance.

2. The improved archery bow assembly of claim 1 wherein said outer blade is bent to provide a single side pressure point.

3. The improved archery bow assembly of claim 1 wherein said inner and outer blades are one of metal or plastic.

4. The improved archery bow assembly of claim 1 wherein said bar slides in said block and is releasably pinned in position therein.

5. The improved archery bow assembly of claim 1 wherein said bar bears threads and is moved incrementally by a wheel in the rear end of said block to adjustably position said bar and blades.

6. The improved archery bow assembly of claim 1 wherein said blades, bar, block, tube, pin and plate are of metal.

* * * * *